US010473424B2

(12) United States Patent
Weimer

(10) Patent No.: US 10,473,424 B2
(45) Date of Patent: Nov. 12, 2019

(54) UNIVERSAL ATTACHMENT MECHANISM FOR SLING

(71) Applicant: Brett R. Weimer, Whitehouse, OH (US)

(72) Inventor: Brett R. Weimer, Whitehouse, OH (US)

(73) Assignee: TwoGunSAMURAI LLC, Denver, CO (US)

( * ) Notice: Subject to any disclaimer, the term of this patent is extended or adjusted under 35 U.S.C. 154(b) by 0 days.

(21) Appl. No.: 15/404,436

(22) Filed: Jan. 12, 2017

(65) Prior Publication Data

US 2017/0205192 A1 Jul. 20, 2017

Related U.S. Application Data

(60) Provisional application No. 62/278,551, filed on Jan. 14, 2016.

(51) Int. Cl.
*F41C 33/00* (2006.01)
*F41C 23/02* (2006.01)

(52) U.S. Cl.
CPC ..... *F41C 33/002* (2013.01); *F41C 23/02* (2013.01)

(58) Field of Classification Search
CPC ..... F41C 33/00; F41C 33/002; F41C 33/001; F41C 23/02
USPC ..... 224/150
See application file for complete search history.

(56) References Cited

U.S. PATENT DOCUMENTS 4,311,263 A * 1/1982 Bianchi ..... F41C 33/002 224/150
4,760,944 A * 8/1988 Hughes ..... F41C 33/00 124/23.1
4,768,689 A * 9/1988 Davis ..... A45F 3/14 224/150
4,823,998 A * 4/1989 Johnson ..... F41C 23/02 224/150
5,082,155 A * 1/1992 Salvador ..... F41C 33/001 224/150
5,092,505 A * 3/1992 Olschlager ..... F41C 23/02 224/149
5,353,538 A * 10/1994 Hakedal ..... F41C 23/02 224/150
5,575,411 A * 11/1996 Hightower ..... F41C 23/02 224/149
5,730,341 A * 3/1998 Hester, Jr. ..... F41B 5/1461 124/88

(Continued)

*Primary Examiner* — Brian D Nash
(74) *Attorney, Agent, or Firm* — Russell D. Nugent

(57) ABSTRACT

A universal attachment mechanism for a sling that uses a flexible length or loop of material to attach the rifle sling to the forestock of the firearm without compromising the ability of the sling to provide support to the user's arm when aiming and firing. The loop of material can also be used to affix the rifle sling directly to the forestock of the firearm. A flexible loop of material is affixed to a sling possibly using a hook-and-loop fastener system affixed to a strap. The strap has at least one inner strap section and at least two outer strap sections each featuring a surface on which is located a hook-and-loop fastener system. The inventor even envisions the flexible loop of material could be used to affix the sling to a rifle missing the traditional hardware used to attach a sling to the forestock of the firearm.

19 Claims, 4 Drawing Sheets

(56) References Cited

U.S. PATENT DOCUMENTS 5,810,219 A * 9/1998 Rosenfield ..... F41C 33/001 224/149
6,019,404 A * 2/2000 Pasquale ..... F41A 17/44 224/150
7,959,046 B2 * 6/2011 Burnsed, Jr. ..... F41C 33/001 224/150
8,096,077 B1 * 1/2012 Caywood ..... F41A 23/005 224/150
8,430,285 B2 * 4/2013 Burnsed, Jr. ..... F41C 23/02 224/150
8,793,916 B2 8/2014 Rogers
8,857,680 B1 10/2014 Thompson
D728,221 S 5/2015 Quinnan
9,052,156 B2 6/2015 Nevils
9,151,568 B2 10/2015 Belanger
9,157,700 B1 10/2015 Hansen
9,410,766 B1 * 8/2016 Falla ..... F41C 33/002
9,587,908 B2 * 3/2017 Bjelde ..... F41C 33/007
9,746,284 B2 * 8/2017 McCarthy ..... F41C 33/002
2006/0011677 A1 * 1/2006 Burnsed, Jr. ..... F41C 33/001 224/150
2007/0145092 A1 * 6/2007 Eberle ..... A45F 3/04 224/650
2008/0217371 A1 * 9/2008 Wemmer ..... F41C 23/02 224/579
2009/0126083 A1 * 5/2009 Holtzclaw, Jr. ..... A41F 9/002 2/300
2011/0186603 A1 * 8/2011 Alford ..... F41C 33/00 224/150
2012/0168470 A1 * 7/2012 Burton ..... F41C 23/02 224/150
2012/0255976 A1 * 10/2012 Dees ..... F41C 33/001 224/150
2014/0203053 A1 * 7/2014 Rivas-Schlanger ..... F41C 33/002 224/150
2015/0076181 A1 * 3/2015 Seuk ..... F41C 33/002 224/150
2015/0292835 A1 * 10/2015 McCarthy ..... F16B 45/02 24/599.6
2016/0120280 A1 * 5/2016 Dingler ..... A45C 3/02 224/608
2016/0265873 A1 * 9/2016 Schuman ..... F41C 33/002
2017/0191793 A1 * 7/2017 McLean ..... F41C 33/002

* cited by examiner

UNIVERSAL ATTACHMENT MECHANISM FOR SLING

CROSS-REFERENCE TO RELATED APPLICATIONS

This Application claims the benefit of priority to U.S. Provisional Application No. 62/278,551 filed on Jan. 14, 2016. The content of U.S. Provisional Application No. 62/278,551 filed on Jan. 14, 2016 is incorporated by reference in its entirety.

BACKGROUND OF THE INVENTION (a) Field of the Invention

The present invention is in the technical field of slings for long guns. More particularly, the present invention is in the technical field of universal attachment mechanisms for slings meant to be used with a long gun such as a rifle.

(b) Background Art

"Long guns" or "shoulder-fired weapons" such as rifles are oftentimes equipped with slings or straps that allow an operator to attach the weapon to his or her body in various configurations so as to carry the weapon when performing a variety of tasks including using the weapon. For example, an operator will typically carry the rifle in front of them and in their hands in situations that may require firing the weapon. Then, when they need the rifle out of their way so they can perform a task that requires their hands to be free, the sling can be reconfigured to attach the rifle closely to their chest or to their back. Having the rifle out of the way allows the operator to use their hands to manipulate other objects, carry a wounded comrade, climb, crawl, swim, etc.

In addition, different rifles will use different hardware to attach the sling to the rifle and generally, some form of quick release buckle in combination with a sling swivel will be used to attach the sling to the front portion of the weapon. Sling swivels and buckles are typically made of hard, durable materials such as metal or polymers and have a number of known disadvantages. Two of the more common disadvantages are noise and inflexibility. Metal on metal produces noise that can be detrimental to an operator trying to stay quiet. In addition, while buckles can be made such that they swivel, durable hardware lacks flexibility and limits movement of the buckle in relation to the sling swivel, operator and rifle.

Typically when the operator holds a rifle, they use the forward arm to draw the weapon's buttstock firmly into the operator's shoulder and to support and stabilize the weapon. A rifle sling can be particularly useful in stabilizing the firearm during aiming and firing. Traditionally, the shooter inserts their non-dominant hand and arm through and around the sling such that when they use that same arm to support the forward portion of the rifle, the sling is wrapped around the shooter's wrist and upper arm. This arrangement takes weight off of the user's bicep and allows the user to relax their upper arm to a degree. In addition, because the strap is also wrapped around the user's wrist, it helps to prevent the user from opening their elbow and thus lowering the rifle.

Moreover, rifle slings are generally attached to the rifle at one to three points of the rifle. The above arrangement requires the sling to be attached at a minimum of two points on the rifle. There are a multitude of different structures that are used to attach the rifle sling to a rifle including the ubiquitous sling swivel. Typically there is a hard durable structure made of metal or a polymer that is affixed to the forward portion of the rifle stock or "forestock" of the rifle and another hard durable metal or polymer structure that is affixed to the rifle sling. These two structures are complementary and secure the rifle sling to the forestock when engaged. However, hard durable structures lack the flexibility necessary to allow the rifle sling to freely move when attached to the forestock. The lack of flexibility can cause the hardware connecting the sling and rifle to slip, resulting in unwanted movement during aiming and firing and can compromise the stabilizing support provided by the rifle sling. In addition, hard durable structures make noise they move and contact each other—a result that can be very undesirable for hunters and military personnel alike.

Rifle slings can also be designed to provide tension and to urge the buttstock of the weapon against the operator's shoulder thus stabilizing the firearm during firing. For example, U.S. Pat. No. 9,052,156 issued to Nevils et al. (hereinafter the "'156 patent") discloses a rifle sling having a forearm connector portion that attaches to a firearm at three points and a user connector portion that attaches the sling to the body of the user. The user connects the forearm connector portion to a rifle with a bipod attachment, then attaches the sling to his or her body and connects the two portions by engaging a quick-release clasp. The system includes a resilient strap section made of an elastic material that applies tension between the rifle and the operator. However, since an elastic material being stretched at both ends tends to pull both ends of the elastic material towards one another, the elasticity of the resilient strap section would tend to pull the buttstock away from the operator's shoulder as much as it pulls the forestock and/or bipod towards it.

Consequently, there is a need for a sling to be used with a rifle or other long gun, that does not have the drawbacks associated with using hard durable structures to connect the sling to the forestock of the rifle and does not compromise the support a sling provides the shooter's extended arm by using elastic components.

BRIEF SUMMARY OF THE INVENTION

The present invention is a universal attachment mechanism for a sling meant to be used with a long gun such as a rifle. The system is universal in the sense that it can be used to attach a sling to virtually any long gun in existence. The system includes a flexible loop of material that allows the shooter to attach the rifle sling to the forestock of the firearm without compromising the ability of the sling to provide support to the user's arm when aiming and firing. It is important to note, flexibility, not elasticity is the desired characteristic of this loop of material. Flexibility is the ability to bend without breaking while elasticity is the ability to resume shape spontaneously after contraction or deformation. As discussed above, too much elasticity compromises the ability of the sling to provide support to the user's arm when supporting the firearm's weight.

In a preferred embodiment and best mode of the presently contemplated attachment mechanism, a flexible loop of material is affixed to a rifle sling such that it can be releasably engaged with the rifle sling. Any number of attachment means could be used to fit this purpose, but in a preferred embodiment, the inventor has used a hook-and-loop fastener system to affix the flexible loop of material to the rifle sling. More specifically, the flexible loop of material is attached to a strap having at least one inner section and two or more outer sections. The inner section of the strap features two opposing surfaces—a top and a bottom. These opposing surfaces each feature a fastening component from a hook-and-loop fastener system. Similarly, the two or more outer sections of the strap each have two opposing surfaces, only one of which features a fastening component from a hook-and-loop fastener system. Each of the outer sections of the strap are positioned to fold over one of the opposing surfaces of the inner section of the strap such that the fastening components of the hook-and-loop fastener system on the outer sections of the strap engage with the fastening components of the hook-and-loop fastener system on the opposing surfaces of the inner section of the strap. In some preferred embodiments, the fastening component on the outer straps are the hooks of a hook-and-loop fastener system and the fastening component on the opposing surfaces of the inner section of the strap are the loops or the loop pile fabric used in a hook-and-loop fastener system. The strap is attached to a rifle sling through traditional attachment means, sewn fabric, buttons, hook-and-loop fasteners, snaps, etc. In some preferred embodiments, the strap is roughly Y-shaped in that there are two arms of the strap that are connected at one end. One arm of the strap contains the inner section and one outer section and the other arm of the strap just features the other outer section. This arrangement allows the operator to slip the longer arm featuring both inner and outer strap sections through the flexible loop of material so that the outer and inner strap sections can engage and secure the flexible loop of material.

Referring now back to the flexible loop of material, the same loop of material can be used to affix the rifle sling to the forestock of the firearm directly. In other words, the inventor even envisions the flexible loop of material could be used to affix the sling to a rifle missing the traditional hardware used to attach a sling to the forestock of the firearm. Furthermore, the strength of the system is enhanced by using a tri-fold strap with dual hook-and-loop fastener systems to affix the flexible loop to the sling. A skilled artisan will immediately recognize the flexible material being affixed to the rifle sling using other conventional means of attachment, whether permanent or releasable, including but not limited to snaps, buttons, or the flexible loop of material could be sewn to a strap of material that does not open or close.

DETAILED DESCRIPTION OF THE INVENTION

Figure 1:
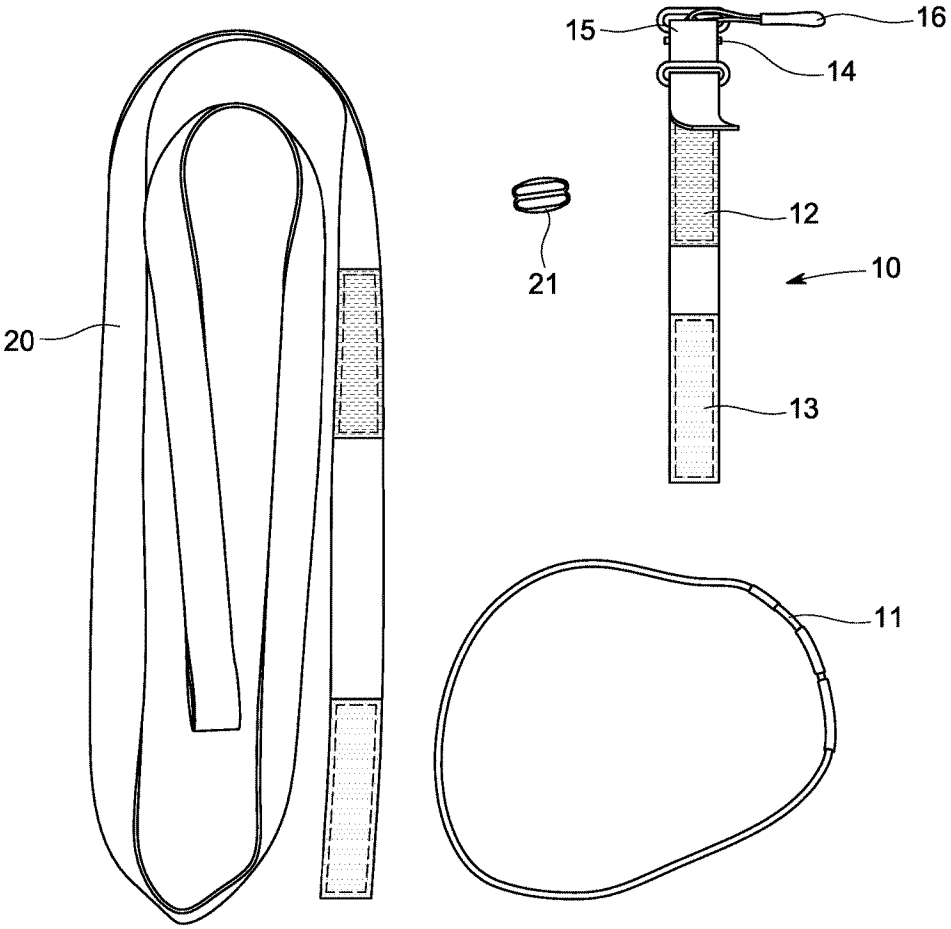
FIG. 1 is a top view of the various components of the universal attachment mechanism with a sling.

Referring now to the invention in more detail, in FIG. 1 there is shown the universal attachment mechanism 10 together with a traditional rifle sling 20 and the preferred means of attaching the attachment mechanism to the rifle sling 20. The universal attachment mechanism 10 consists of a length of flexible material 11 that in a preferred embodiment is in the shape of a loop. In addition, FIG. 1 features the preferred means by which the sling 20 is attached to the length of flexible material 11—a strap 12 sporting one or more hook-and-loop fastener systems 13 that can be affixed around the length of material 11. In addition, FIG. 1 shows a cam buckle 14 with a thumb release 15 and a short cord 16 attached to the thumb release 15 as well as a metal slide 21.

Figure 2:
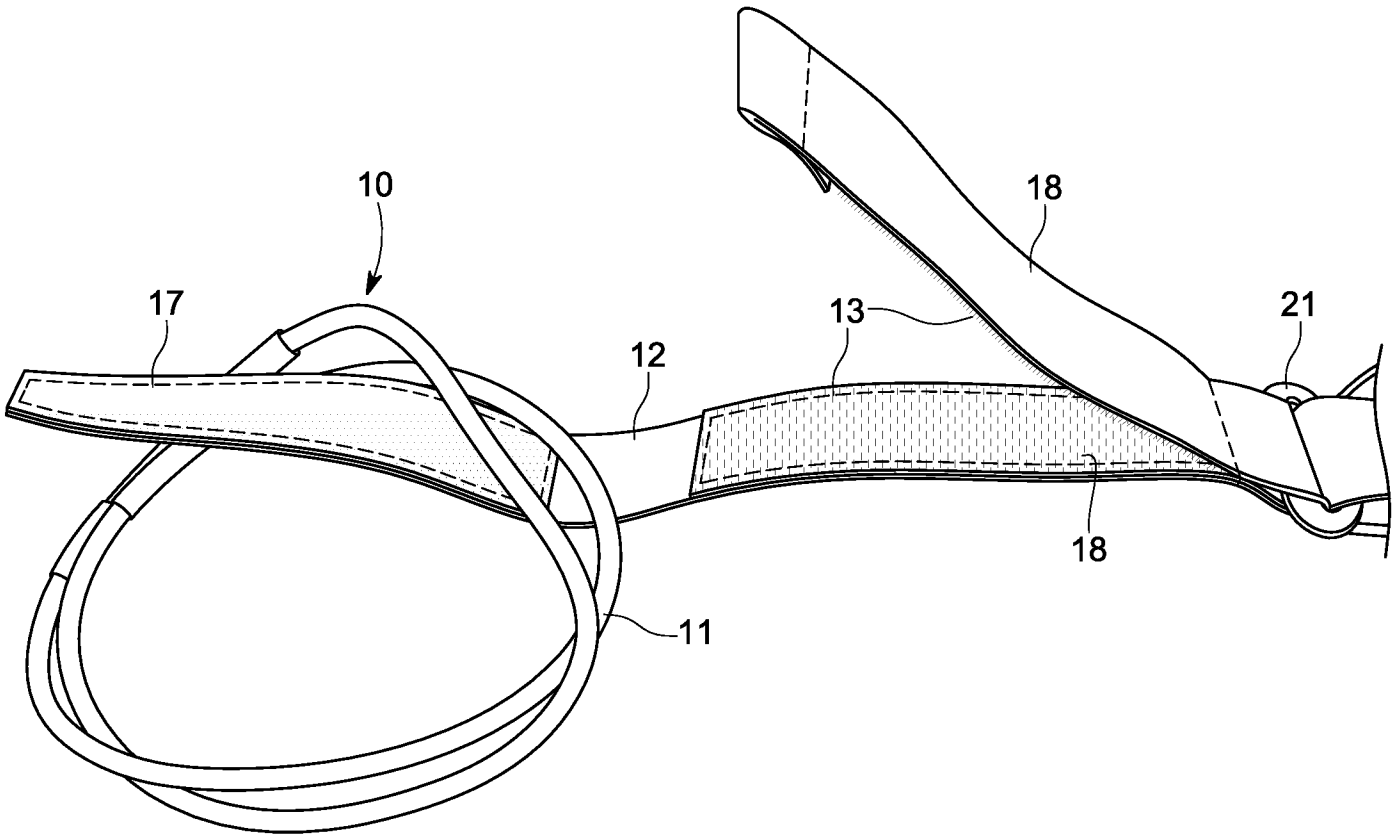
FIG. 2 is a top view of the strap and loop components of the present invention.

FIG. 2 shows the strap 12 in more detail. As mentioned previously, any number of attachment means can be used to attach the flexible length of material 11 to the sling 20 including snaps, buttons, or alternately, the flexible loop of material could be sewn to a loop of material that has been sewn closed or otherwise does not open. However, in preferred embodiments, the strap 12 features the components of a touch fastener such as a hook-and-loop or hook-and-pile fastener. In these embodiments, the strap 12 has a three part structure with an inner strap section 17 and two outer strap sections 18. The strap 12 consists of two opposing lengths of material each attached to each other at a single end. One of these opposing lengths of material is longer than the other. The longer length of the strap features two sections equipped with each of the components of a hook-and-loop fastener system 13. In addition, the shorter length of strap is equipped with one portion of a hook-and-loop fastener system 13. More specifically, in preferred embodiments, the inner strap section 17 is equipped with the loops of a hook-and-loop fastener system 13 on each of its surfaces and each outer strap section 18 features the hooks of a hook-and-loop fastener system 13 on the surface that is opposed to or faces the inner strap section 17 when the inner strap section 17 is folded back towards the outer strap sections 18. Thus each outer strap section 18 is configured to fold over and engage with one side of the inner strap section 17 via use of the hook-and-loop fastener system 13.

In use, the inner strap section 17 is inserted through the flexible length of material 11 and then folded back towards the outer strap sections 18 thereby allowing the hook-and-loop fastener system to engage both sides of the inner strap 17. The advantage of this structural arrangement is that the hooks of the hook-and-loop fastener system 13 are affixed to the inside of the outer strap section 18 allowing secure retention of the length of loop of material 11 regardless of which end of the strap 12 experiences a pulling force. In a preferred embodiment, one of the ends of the strap 12 is sewn in a loop around one end of a metal slide 21 allowing connection of the strap 12 to a traditional rifle sling (not shown).

Figure 3:
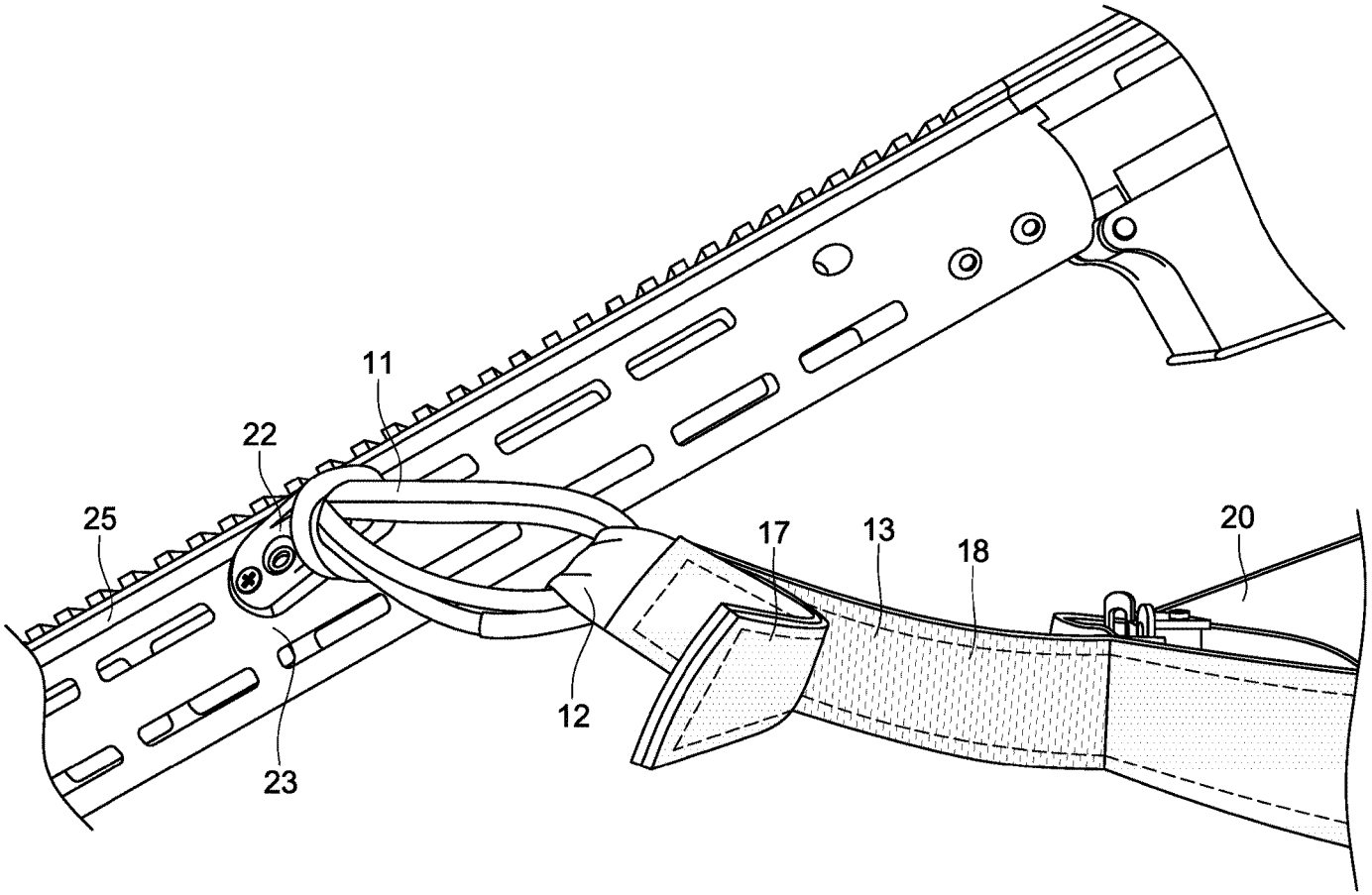
FIG. 3 is a side view of universal attachment mechanism attached to a rifle.

Referring now to the invention in more detail, in FIG. 3 there is shown the length of material 11 attached to a mounting bracket 22 on the forestock 23 of a rifle 25 at one end and the strap 12 at the other. Specifically, in the preferred embodiment and best mode, the length of material 11 is made of parachute cord that is more than 20.0 inches in circumference and is ideally approximately 22.0 inches in circumference. In some preferred embodiments, the flexible loop of material is folded over itself forming a double loop structure that is 10.0 to 12.0 inches in diameter, preferably 11.0 inches in diameter. The parachute cord can be wrapped with an insulating material such as shrink wrap tape, electrical tape or other insulating material to help prevent fraying of the length of material 11 is cut or nicked. Paracord or 550 parachute cord refers to genuine MIL-SPEC MIL-C-5040 Type III Paracord having 7 to 9 inner yarns each made up of 3 strands. Parachute cord (also paracord or 550 cord when referring to type-III paracord) is a lightweight nylon kernmantle rope originally used in the suspension lines of parachutes.

The length of material or loop 11 can serve to attach the sling 20 to the forestock 23 of the rifle by feeding the loop 11 through a mounting bracket 22, sling swivel or other hardware on the forestock 23 of the rifle and feeding an end of the loop 11 back through itself effectively forming a slip knot. Alternately, the length of material 11 can be attached directly to the forestock of the rifle 25 by simply wrapping the length of material 11 around the forestock 23 of a rifle 25 and then inserting one portion of the loop through the rest of the loop, just as with the mounting bracket. Furthermore, FIG. 3 illustrates the attachment of the loop 11 to the strap 12. The outer strap sections 18 are detached from the inner strap section 17 which is then inserted through the loop 11 and re-engaged with the outer strap sections 18.

Figure 4:
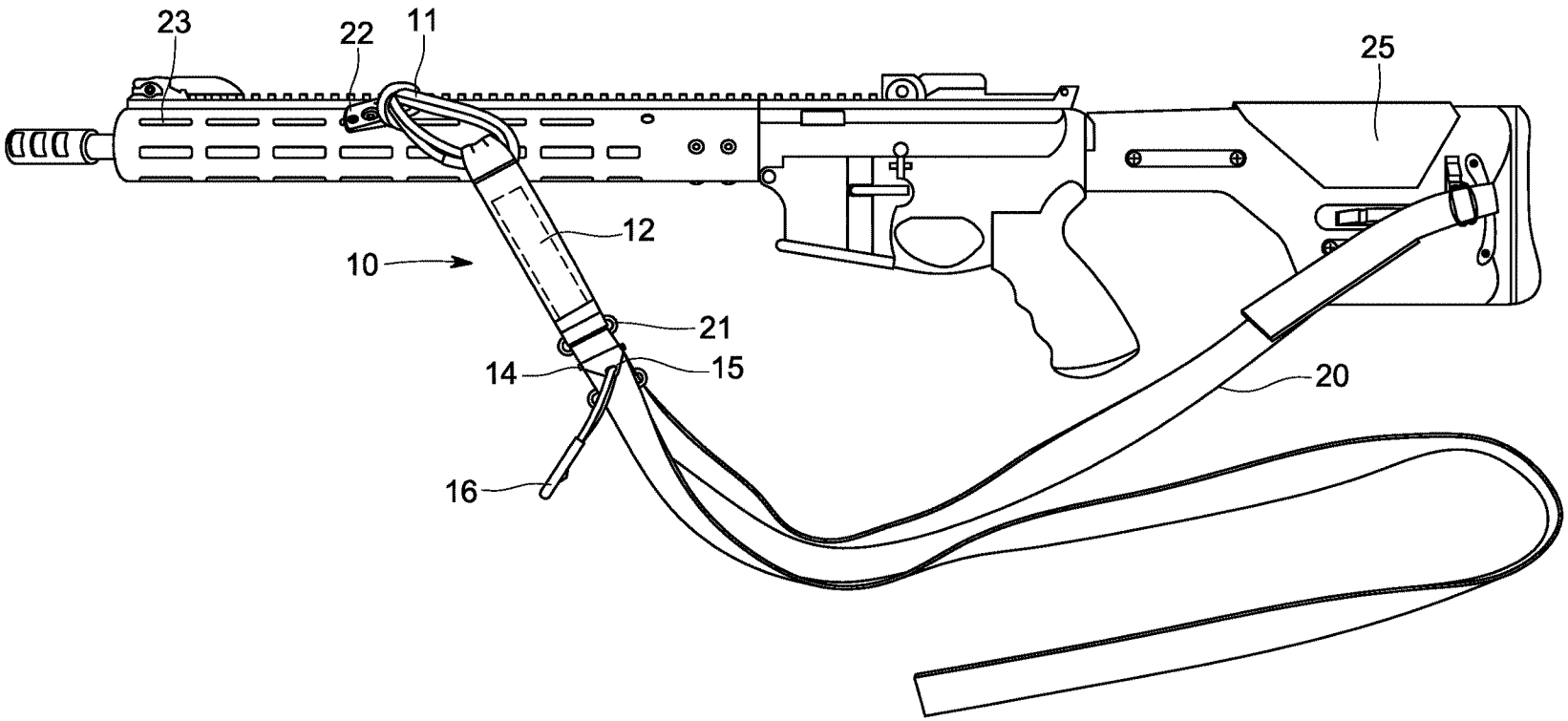
FIG. 4 is another side view of universal attachment mechanism attached to a rifle.

Referring to the invention in still further detail, FIG. 4 shows the universal attachment mechanism 10 engaged with a rifle sling 20 attached to a rifle 25. More particularly, the length of material 11 is formed into the shape of a loop. FIG. 4 shows the loop 11, having been folded upon itself one time to create two loops or a double loop that have/has been inserted into the mounting bracket 22 on the forestock 23 of a rifle 25. The loop 11 has been tied to the mounting bracket 22 by inserting one end of the loop through other end of the loop such that the loop 11 is securely tied via a slip knot. FIG. 4 also shows the strap 12 engaged with another end of the loop 11. The other end of the strap 12 is affixed to a slide 21 that has a side engaged with a rifle sling 20.

The flexibility of the loop 11 allows movement between the sling 20 and the forestock 23 of the firearm 25 without two or more hard surfaces contacting each other and thereby decreasing the flexibility of the connection between the rifle and the sling or producing noise. The cam buckle 14 with thumb release 15 allow the user to easily and quickly lengthen and shorten the rifle sling 20 allowing the shooter to rearrange the rifle and wear it in any number of configurations including placing the rifle behind them or tightening it to their torso so the rifle is in front of them while they keep their hands free. The easy adjustment of the rifle strap also allows the user to customize the length of the rifle sling 20 to provide support for the extended arm that supports the forestock 23 of the rifle during aiming and firing. The shooter need only insert their non-dominant arm through the sling 20 and wrap it around their upper arm and wrist. Upon tightening the sling 20, the rifle sling 20 supports the shooter's upper arm and wrist allowing them to use less effort to support the rifle 25 while aiming and firing.

Reference throughout the specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout the specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

It is understood that the above described embodiments are only illustrative of the application of the principles of the present invention. The present invention may be embodied in other specific forms without departing from its spirit or essential characteristics. The described embodiment, including the best mode, is to be considered in all respects only as illustrative and not restrictive. The scope of the invention is, therefore, indicated by the appended claims, if any, in conjunction with the foregoing description.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

I claim:

1. An attachment system for a sling for a firearm comprising:

a flexible, inelastic, and continuous loop of material directly attached to a stock of a firearm, a strap comprising:

two opposing lengths of material of unequal length, each attached to each other at a single end, an inner section and two outer sections, wherein each section includes a fastening component of a hook-and-loop fastener system; wherein the longer of the two opposing lengths of material of unequal length features one outer section and one inner section of the strap while the shorter of the two opposing lengths of material of unequal length features a single outer strap section.

2. The attachment system of claim 1 wherein the outer sections of the strap each feature a surface with a fastening component from a hook-and-loop fastener system and the inner section of the strap has two opposing surfaces each opposing surface featuring a fastening component of a hook-and-loop fastener system that is complementary to the fastening components on the outer strap sections and one of the outer sections of the strap are positioned to fold over one of the opposing surfaces of the inner section of the strap while the other outer section is positioned to contact the opposing surface of the inner strap section such that the fastening components of the hook-and-loop fastener system on the outer sections of the strap engage with the fastening components of the hook-and-loop fastener system on the opposing surfaces of the inner section of the strap.

3. The attachment system of claim 2 wherein the flexible loop of material comprises 550 parachute cord wrapped in an insulating material.

4. The attachment system of claim 2 wherein the flexible loop of material is folded to form a double loop.

5. The attachment system of claim 1 wherein the flexible loop of material is folded to form a double loop.

6. The attachment system of claim 5 wherein the flexible loop of material is folded to form a double loop.

7. The attachment system of claim 1 wherein the flexible loop of material comprises 550 parachute cord wrapped in an insulating material.

8. The attachment system of claim 1 wherein the flexible loop of material comprises 550 parachute cord wrapped in an insulating material.

9. The attachment system of claim 1 wherein the flexible loop of material is releasably attached to the strap.

10. The attachment system of claim 1 wherein the flexible loop of material is folded to form a double loop.

11. A sling for a firearm comprising:

a flexible, inelastic loop of material at an end of the sling; the loop of material being attached to a strap and the stock of a firearm, said strap comprising two opposing unequal lengths of material, each attached to each other at a single end, said strap also having an inner section and two outer sections, wherein the outer sections of the strap each feature a surface with a fastening component from a hook-and-loop fastener system and the inner section of the strap has two opposing surfaces each opposing surface featuring a fastening component of a hook-and-loop fastener system that is complementary to the fastening components on the outer strap sections and one of the outer sections of the strap are positioned to fold over one of the opposing surfaces of the inner section of the strap while the other outer section is positioned to contact the opposing surface of the inner strap section such that the fastening components of the hook-and-loop fastener system on the outer sections of the strap engage with the fastening components of the hook-and-loop fastener system on the opposing surfaces of the inner section of the strap and the longitudinal axis of each section runs in the same lengthwise direction.

12. The sling of claim 11 wherein the fastening component on the two outer sections of the strap are hooks of a hook-and-loop fastener system.

13. The attachment system of claim 12 wherein the flexible loop of material comprises 550 parachute cord wrapped in an insulating material.

14. The attachment system of claim 12 wherein the flexible loop of material is folded to form a double loop.

15. The attachment system of claim 11 wherein the flexible loop of material comprises 550 parachute cord wrapped in an insulating material.

16. The attachment system of claim 15 wherein the flexible loop of material is folded to form a double loop.

17. The attachment system of claim 11 wherein the diameter of the flexible loop of material is between 21.0 inches and 23.0 inches.

18. The attachment system of claim 11 wherein the flexible loop of material is folded to form a double loop.

19. The attachment system of claim 11 wherein the flexible loop of material is releasably attached to the strap.

* * * * *